US005657808A

United States Patent [19]

Lin

[11] Patent Number: 5,657,808

[45] Date of Patent: Aug. 19, 1997

[54] CURTAIN ASSEMBLY

[76] Inventor: Kent Lin, No. 10, Tsui-Ping Lane, Chen-Nan St., Ching-Shui Chen, Taichung Hsien, Taiwan

[21] Appl. No.: 563,423

[22] Filed: Nov. 28, 1995

[51] Int. Cl.[6] ..... A47H 1/00

[52] U.S. Cl. ..... 160/330; 160/350; 160/385

[58] Field of Search ..... 160/330, 350, 160/385, 386, 387, 394, 397, 402, 403; 211/45, 46; 248/262

[56] References Cited

U.S. PATENT DOCUMENTS

| | | | |
|---|---|---|---|
| 174,535 | 3/1876 | Johnson | 160/387 |
| 1,450,520 | 4/1923 | Smith | 160/387 |

FOREIGN PATENT DOCUMENTS

| | | | |
|---|---|---|---|
| 1388054 | 12/1964 | France | 160/330 |
| 497606 | 12/1938 | United Kingdom | 160/262 |
| 1263090 | 2/1972 | United Kingdom | 160/330 |

*Primary Examiner*—Blair Johnson
*Attorney, Agent, or Firm*—Lowe, Price, LeBlanc & Becker

[57] ABSTRACT

A curtain assembly includes an elongated horizontal holding frame, a pair of spaced-apart hanging units, a curtain sheet, and an elongated horizontal plastic strip. The holding frame has an upper portion with a dovetail groove formed along the entire length thereof, and a hollow lower portion which is integrally formed with the upper portion and which has a bottom wall unit through which a slit is formed along the entire length of the frame. The hanging units are sleeved respectively around the holding frame and are adapted to be mounted on a wall so as to suspend the holding frame above a window that is formed through the wall. Each of the hanging units has a dovetail tongue engaged slidably in the groove of the holding frame. The sheet extends through the slit of the frame and has a folded annular upper end portion accommodated in the lower portion of the holding frame. The plastic strip is inserted detachably into and attached to the annular folded upper end portion of the sheet and has a length approximate to that of the frame so that the folded annular upper end portion of the sheet cannot drop from the frame through the slit. The folded annular upper end portion of the sheet and the strip can be passed through the slit for removal from the frame when turned into a vertical position.

1 Claim, 7 Drawing Sheets

CURTAIN ASSEMBLY

BACKGROUND OF THE INVENTION

1. Field of the Invention

The invention relates to a curtain assembly, more particularly to a curtain assembly with an elongated curtain-holding frame and a curtain sheet which can be mounted in the holding frame with ease.

2. Description of the Related Art

Referring to FIGS. 1 and 2, a conventional curtain assembly includes an elongated horizontal holding frame 10, a pair of spaced hanging units 13, 14, a rope unit 15, and a curtain sheet 20. As illustrated, the holding frame 10 has a front portion with a dovetail groove 11 formed along the entire length thereof, and a rear portion 12 which is integrally formed with the front portion and which has a bottom wall unit 120 through which a slit 121 is formed along the entire length of the frame 10. The hanging units 13, 14 are spaced apart from each other and have lower portions which are confined in the dovetail groove 11 of the frame 10. Each of the hanging units 13, 14 includes a hook 130, 140 for attachment to the wall and extends through a longitudinal slot formed through a top portion of the frame 10 in order to suspend the frame 10 above a window formed through the wall. The sheet 20 extends through the slit 121 of the frame 10 and has a folded upper end portion 21 accommodated in the rear portion 12 of the frame 10, and a lower end portion that extends downwardly from the frame 10 so as to shield the window. After assembly, two end portions of the frame 10 are closed respectively with two covering caps 16.

A main drawback encountered during the assembly of the aforesaid curtain assembly is that, since the curtain sheet 20 is easily creased, it is difficult to insert the curtain sheet 20 through the slit 121 of the frame 10. Furthermore, as illustrated in FIG. 3, when the sheet 20 is pulled downward, the folded upper end portion 21 of the sheet 20 may easily drop from the frame 10.

SUMMARY OF THE INVENTION

Therefore, the main object of this invention is to provide a curtain assembly that has an elongated horizontal holding frame and a curtain sheet which can be easily inserted into the frame.

Accordingly, the curtain assembly of this invention includes an elongated horizontal holding frame, a pair of spaced-apart hanging units, a curtain sheet, and an elongated horizontal plastic strip. The holding frame has an upper portion with a dovetail groove formed along an entire length thereof, and a hollow lower portion which is integrally formed with the upper portion and which has a bottom wall unit through which a slit is formed along the entire length of the frame. The hanging units are sleeved around the holding frame and are adapted to be mounted on a wall so as to suspend the holding frame above a window that is formed through the wall. Each of the hanging units has a dovetail tongue engaged slidably in the groove of the holding frame. The sheet extends through the slit of the frame and has a folded annular upper end portion accommodated in the lower portion of the holding frame so as to shield the window located below the holding frame. The plastic strip is inserted detachably into and attached to the folded annular upper end portion of the sheet and has a length approximate to that of the frame so that the folded annular upper end portion of the sheet cannot drop from the frame through the slit. The folded annular upper end portion of the sheet and the strip can be passed through the slit for removal from the frame when turned into a vertical position.

In assembly, after the plastic strip is inserted into the folded annular upper end portion of the sheet, the folded annular upper end portion of the sheet can be easily passed through the slit of the frame by virtue of the rigidity of the plastic strip so as to move into the lower portion of the frame.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENT

Figure 1:
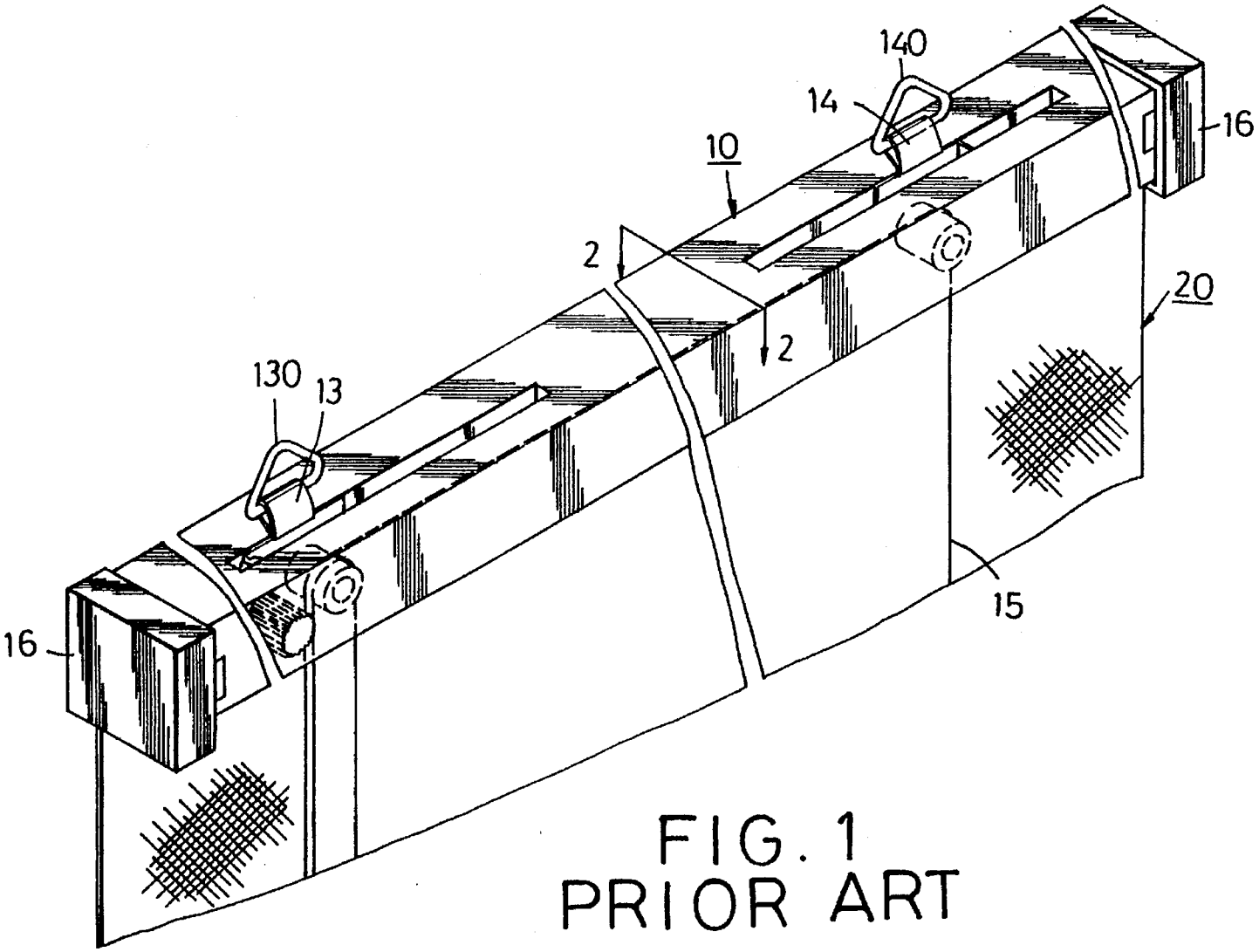
FIG. 1 PRIOR ART
FIG. 1 is perspective view of a portion of a conventional curtain assembly.
Figure 2:
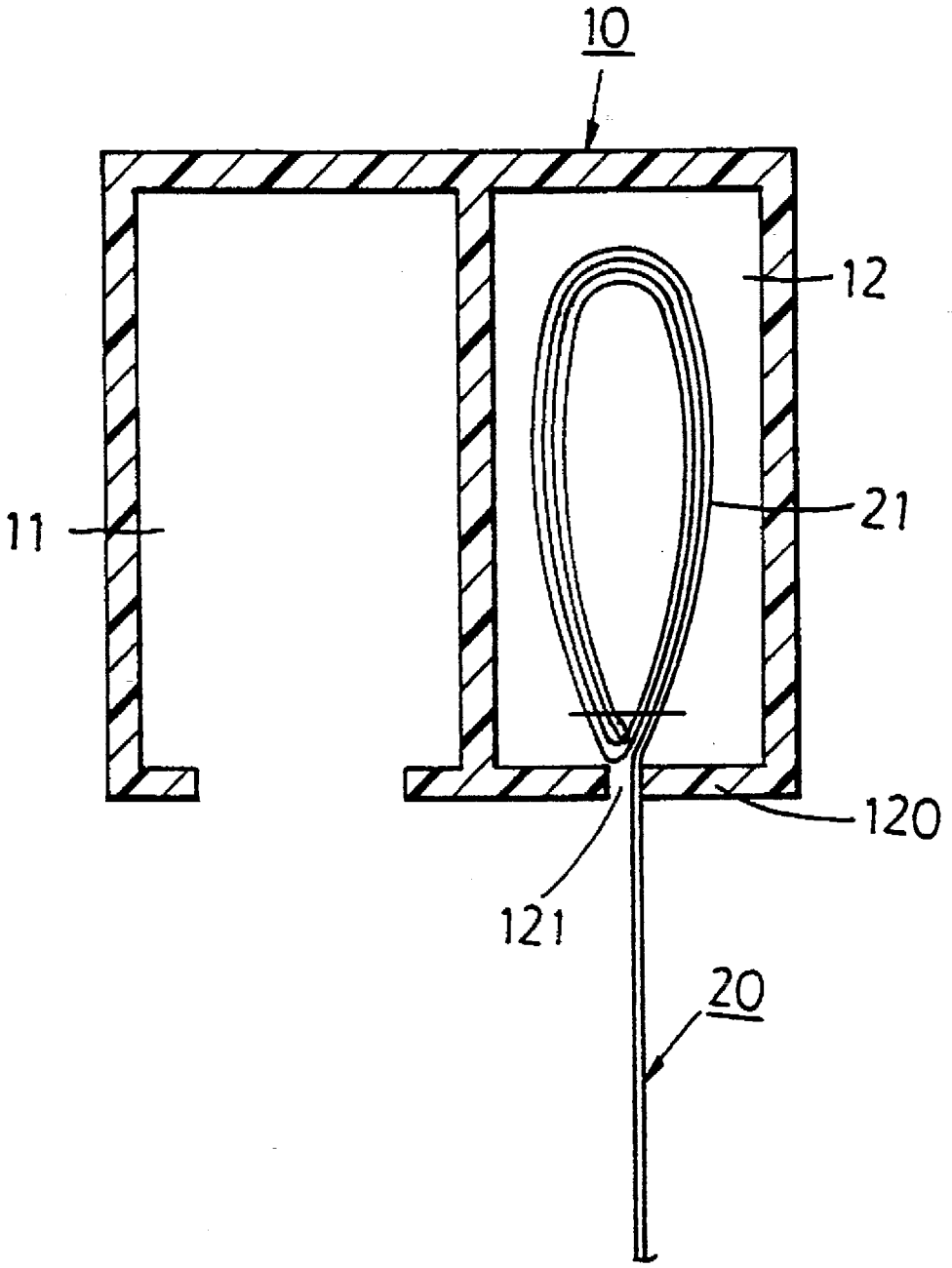
FIG. 2 PRIOR ART
FIG. 2 shows a cross sectional view taken along the line 2—2 in FIG. 1.
Figure 3:
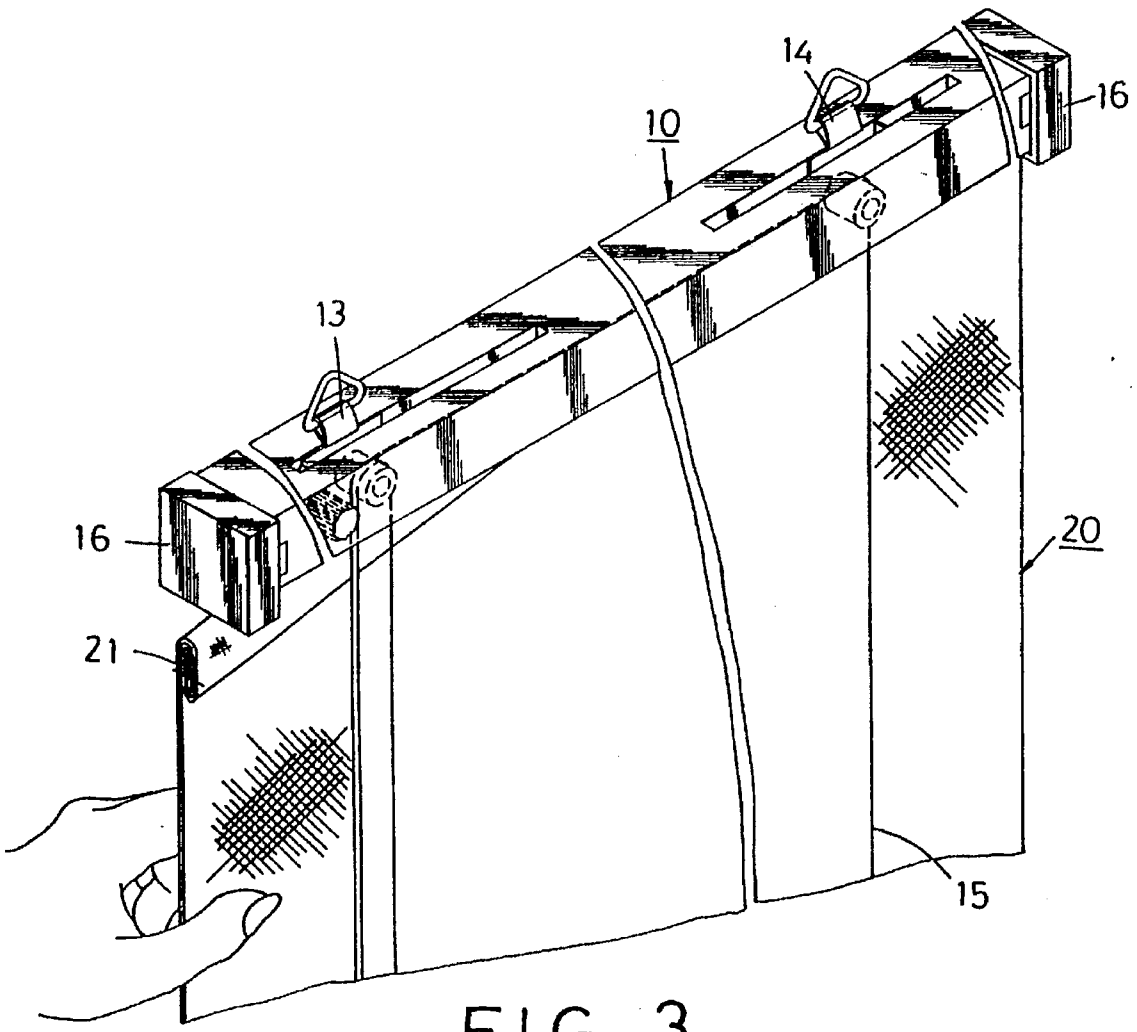
FIG. 3 PRIOR ART
FIG. 3 illustrates how a downward pull on a side portion of the curtain sheet in the conventional curtain assembly can cause detachment of the sheet.
Figure 4:
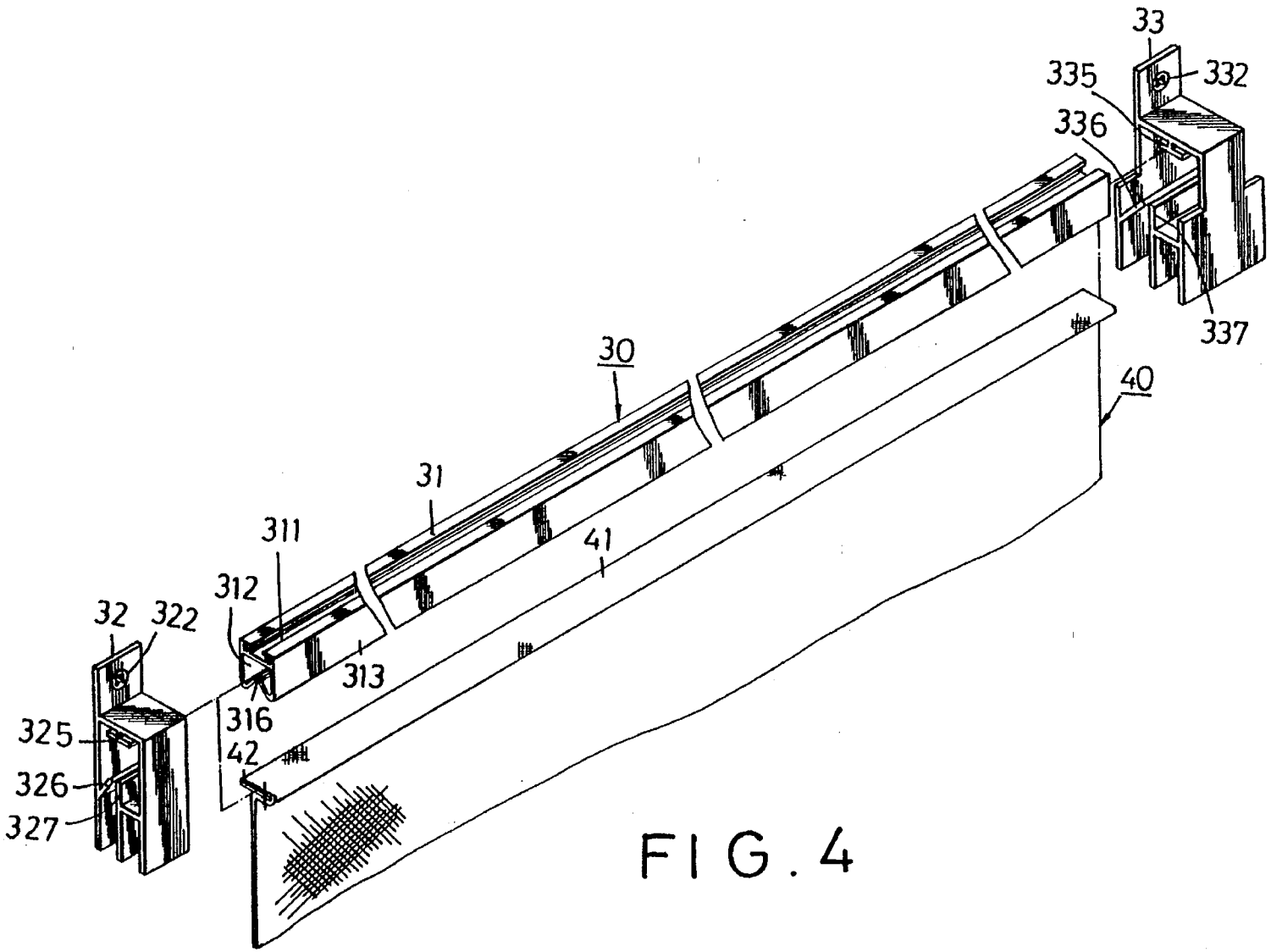
FIG. 4 is an exploded view of a curtain assembly of this invention.
Figure 5:
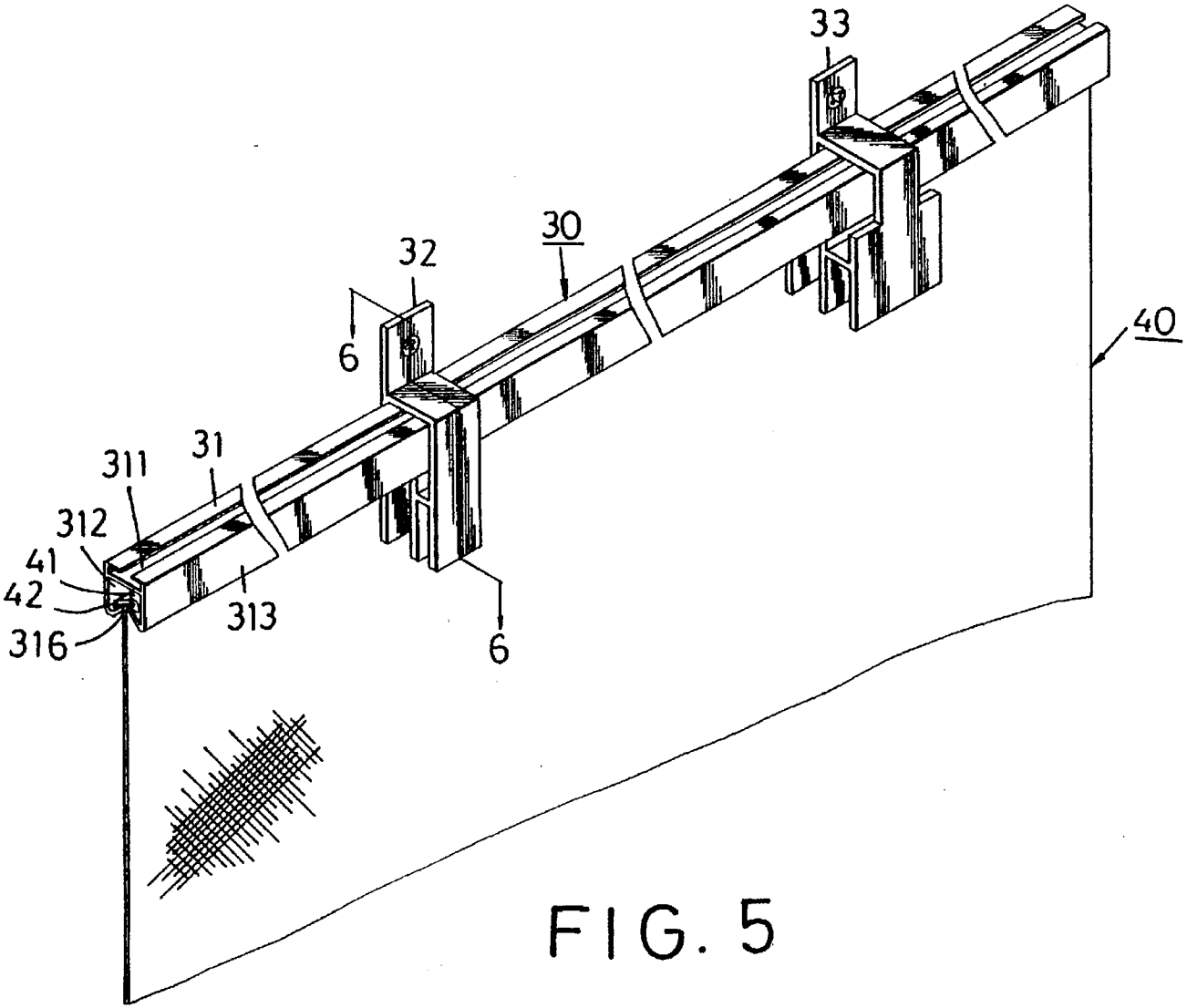
FIG. 5 is a perspective view of the curtain assembly of this invention.

Referring to FIGS. 4 and 5, the curtain assembly of this invention includes an elongated horizontal holding frame 30, a pair of spaced-apart hanging units 32, 33, a curtain sheet 40, and an elongated horizontal plastic strip 42.

As illustrated, the holding frame 30 is made of plastic and has an upper portion 31 with a dovetail groove 311 formed along the entire length thereof, and a hollow lower portion which is integrally formed with the upper portion 31 and which has a bottom wall unit through which a slit 316 is formed along the entire length of the frame 30. The slit 316 divides the bottom wall unit of the lower portion of the frame 30 into two inclined wall sections 312, 313. The inclined wall sections 312, 313 have upper ends between which the slit 316 is defined.

The hanging units 32, 33 are made of plastic and are sleeved respectively around the holding frame 30. Each of the hanging units 32, 33 has a through hole 322, 333 formed through the upper end portion thereof by which the hanging units 32, 33 are mounted on a wall by means of screws so as to suspend the holding frame 30 above a window formed through the wall.

Figure 6:
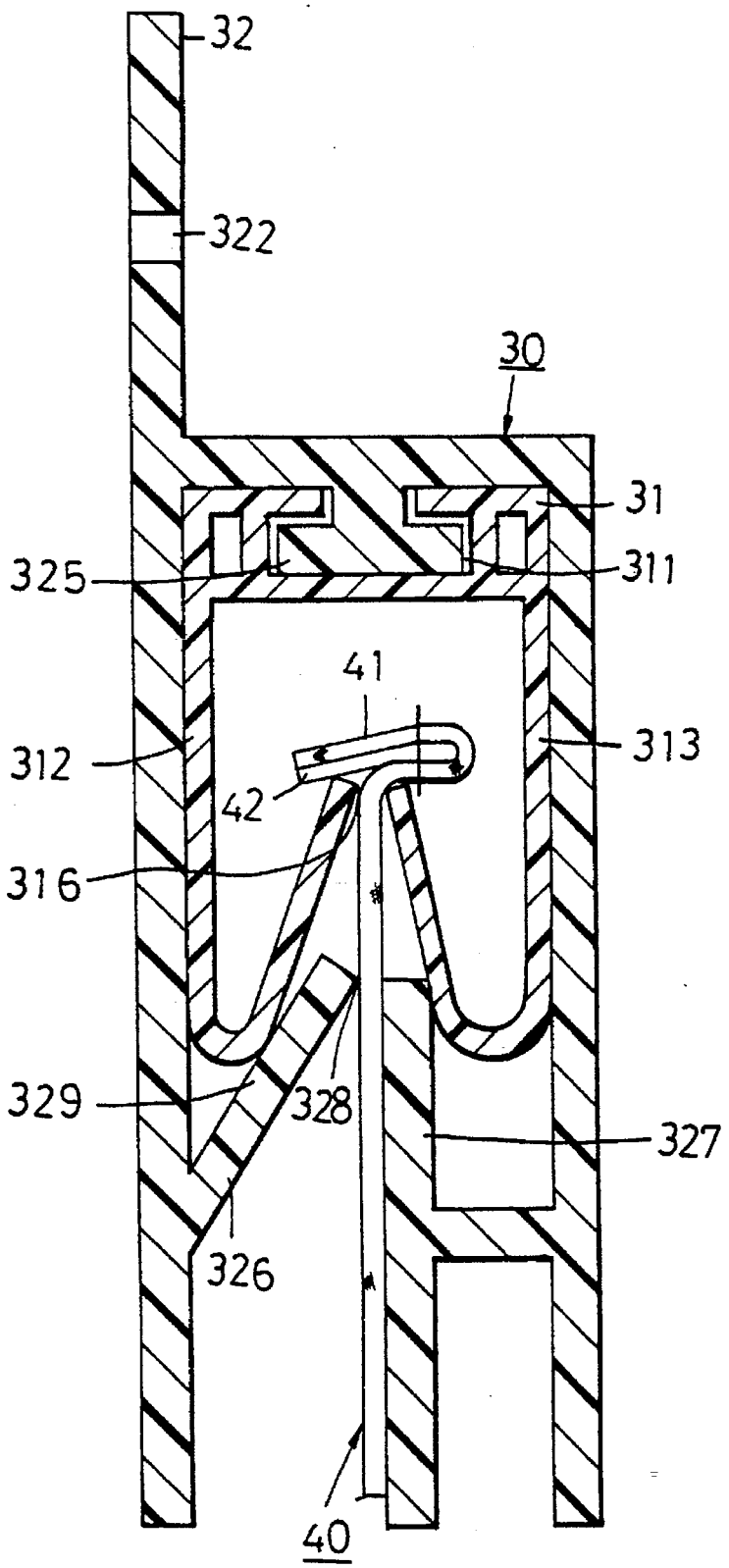
FIG. 6 is a cross sectional view of the curtain assembly taken along line 6—6 in FIG. 5.

Referring to FIGS. 4, 5 and 6, each of the hanging units 32, 33 has a dovetail tongue 325, 335 engaged slidably in the groove 311 of the holding frame 30, an integral vertical plate 327, 337 located under the slit 316 of the frame 30, and an inclined pressing plate 326, 336 having a lower end integrally formed with the remaining portion of the hanging unit 32, 33 and an intermediate portion 329 which is depressed by the lower end portion of the inclined wall section 312 of the bottom wall unit of the frame 30.

The sheet 40 extends through the slit 316 of the frame 30 and has a folded annular upper end portion 41 accommodated in the lower portion of the holding frame 30 so as to shield the window (not shown) located below the holding frame 30. The plastic strip 42 is inserted into the folded annular upper end portion 41 of the sheet 40 and has a length approximate to that of the frame 30 so that the folded annular upper end portion 41 of the sheet 40 cannot drop from the frame 30 through the slit 316. Under this condition, in the left hanging unit 32, an intermediate portion of the curtain sheet 40 overlaps on the vertical plate 327 of the hanging unit 32 while a lower end portion of the inclined wall section 312 of the bottom wall unit of the holding frame 30 depresses an intermediate portion 329 of the inclined pressing plate 326 in such a manner that the upper end 328 of the inclined pressing plate 326 abuts against the intermediate portion of the sheet 40 so as to assist in supporting the curtain sheet 40 in the lower portion of the frame 30. The right hanging unit 33 is similar to the left hanging unit 32 in construction and will not be described further.

In assembly, after the plastic strip 42 is inserted into the folded annular upper end portion 41 of the sheet 40, the folded annular upper end portion 41 of the sheet 40 can easily pass through the slit 316 of the frame 30 by virtue of the rigidity of the plastic strip 42 so as to move into the lower portion of the frame 30. If desired, the annular upper end portion 41 of the sheet 40 can be passed through the slit 316 for removal from the frame 30 when turned into a vertical position.

Figure 7:
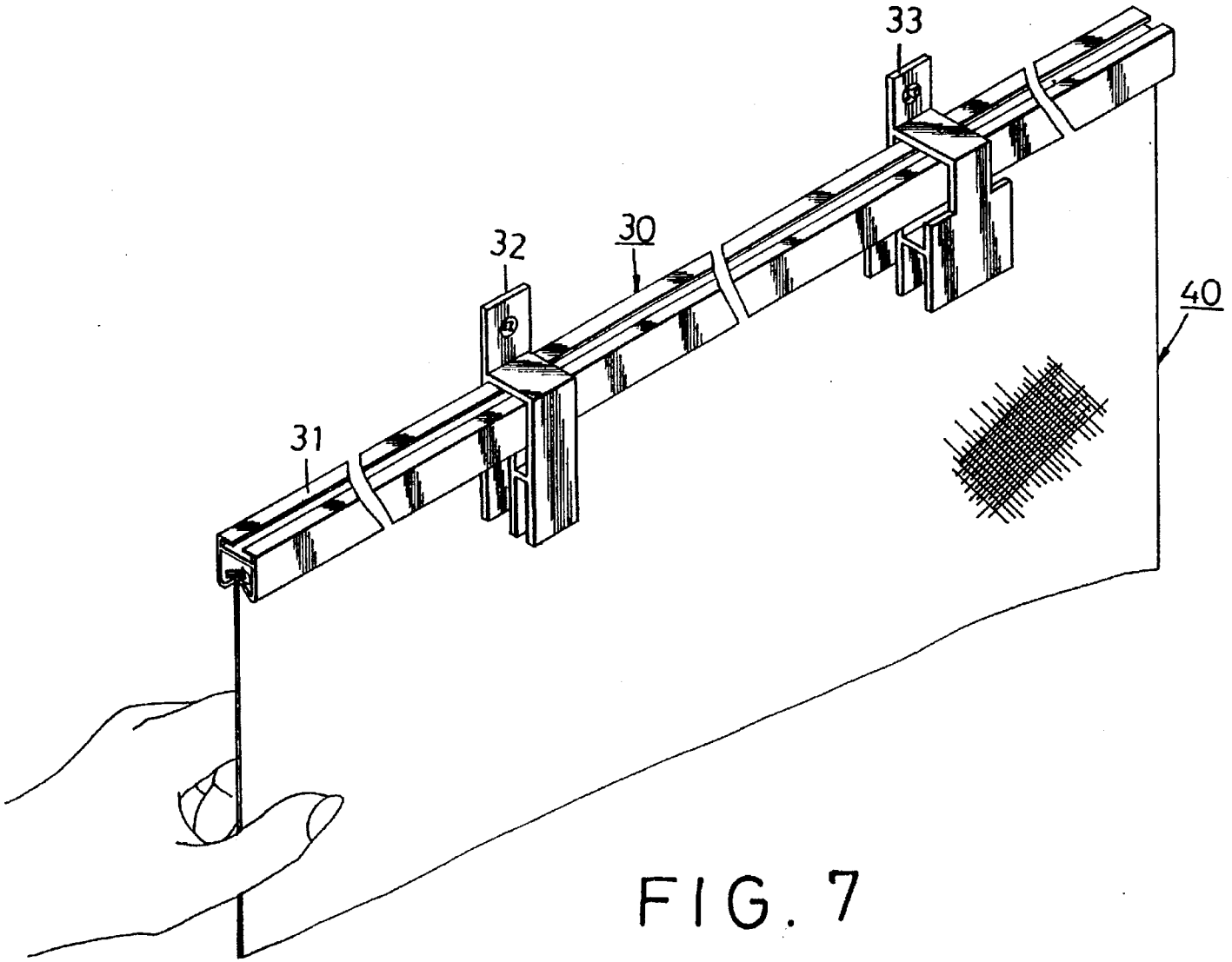
FIG. 7 illustrates how a downward pull on a side portion of the curtain sheet in this curtain assembly does not cause detachment of the sheet.

As illustrated in FIG. 7, a downward pull on one side of the sheet 40 cannot cause the folded annular end portion 41 of the sheet 40 to slide through the slit 316 of the frame 30 due to the fact that the plastic strip 42 is confined in the lower portion of the holding frame 30 by the inclined plate sections 312, 315 which are in turn supported by the inclined pressing plate 326 and the vertical plate 327 of the hanging unit 32.

With the invention thus explained, it is obvious to those skilled in the art that various modifications and variations can be made without departing from the scope and spirit thereof. It is therefore intended that the invention be limited only as in the appended claims.

I claim:

1. A curtain assembly, comprising:

an elongated horizontal holding frame having an upper portion with a dovetail groove formed along an entire length of said holding frame, and a hollow lower portion which is integrally formed with the upper portion and which has a bottom wall unit through which a slit is formed along the entire length of said holding frame;

a pair of spaced-apart hanging units sleeved respectively around said holding frame and adapted to be hung on a wall so as to suspend said holding frame above a window formed through said wall, each of said hanging units having a dovetail tongue engaged slidably in the groove of said holding frame;

a curtain sheet extending through said slit of said holding frame and having a folded annular upper end portion accommodated in said lower portion of said holding frame so as to shield the window; and an elongated horizontal plastic strip inserted detachably into and attached to the folded annular upper end portion of said sheet and having a length approximate to that of said frame, said plastic strip being disposed for preventing said folded annular upper end portion of said sheet from dropping from said holding frame through said slit, said plastic strip permitting removal of said folded annular upper end portion of said sheet from said holding frame by passing through said slit when turned into a vertical position, whereby, in assembly, after said plastic sheet is inserted into said folded annular upper end portion of said sheet, said folded annular upper end portion of said sheet can be easily passed through said slit by virtue of rigidity of said plastic strip so as to move into said lower portion of said holding frame, wherein said frame and said hanging units are made of plastic, said slit dividing said bottom wall unit of said lower portion of said frame into two inclined wall sections, said inclined wall sections having upper ends between which said slit is defined, each of said hanging units including an integral vertical plate located under said slit so as to overlap an intermediate portion of said curtain sheet on said vertical plate, and an inclined pressing plate having a lower end integrally formed with remaining portion of said hanging unit, an intermediate portion which is depressed by a lower end portion of one of said inclined wall sections of said bottom wall unit of said holding frame, and an upper end pressing the intermediate portion of said curtain sheet against said vertical plate so as to assist in supporting said curtain sheet on said lower portion of said holding frame.

* * * * *